United States Patent [19]

Secor et al.

[11] 4,147,312

[45] Apr. 3, 1979

[54] GAS-LIQUID HYDRAULIC EXPANDABLE CHUCKS AND SHAFTS

[75] Inventors: Arthur D. Secor; Jerome G. Secor, both of Toledo, Ohio

[73] Assignee: Great Lakes Industries, Inc., Toledo, Ohio

[21] Appl. No.: 835,586

[22] Filed: Sep. 22, 1977

[51] Int. Cl.[2] ..... B65H 75/24

[52] U.S. Cl. ..... 242/72 R; 279/2 A

[58] Field of Search ..... 242/72 R, 72 B, 68.4; 279/2 A, 4; 269/48.1; 82/44

[56] References Cited

U.S. PATENT DOCUMENTS

| | | | |
|---|---|---|---|
| 3,025,071 | 3/1962 | Larrad | 242/72 R X |
| 3,214,109 | 10/1965 | Gadde et al. | 242/72 B |
| 3,253,323 | 5/1966 | Saueressig | 242/72 B X |
| 3,273,817 | 9/1969 | Damiron | 242/72 B |
| 3,552,672 | 1/1971 | Grettve | 242/72 B |
| 4,050,643 | 9/1977 | Secor | 242/72 R |

FOREIGN PATENT DOCUMENTS

| | | | |
|---|---|---|---|
| 163738 | 11/1954 | Australia | 242/72 B |
| 741309 | 11/1955 | United Kingdom | 242/72 R |

*Primary Examiner*—Harvey C. Hornsby
*Assistant Examiner*—John M. Jillions
*Attorney, Agent, or Firm*—Hugh Adam Kirk

[57] ABSTRACT

A self-contained cylindrical expandable mandrel comprising a closed liquid hydraulic system pressurized by the smaller end of a piston, the larger end of which piston is compressed by a gas, such as compressed air from an outside source through a hose connectable to a pneumatic tire-type check valve on the unit. The closed liquid hydraulic system from the smaller end of the piston flexes a plurality of diaphragms directly urging plungers radially outwardly around the cylindrical mandrel for pressing buttons, bars, or leaves against the inside hollow cores of rolls of web or sheet material for positively grabbing these rolls for rotation directly with the shaft connected to the mandrel. Either a pair of these mandrels may be inserted in opposite ends of the core of a roll, or a complete shaft may be extended through the core of the roll from one end to the other, which shaft may be provided either with an air-type bag or accumulator for maintaining an even pressure on the hydraulic system at the end thereof opposite the piston-operating mechanism, or separate piston-operating mechanisms may be installed in each end of the shaft. Resilient means such as spring means may be provided for retracting each of the radially extending plungers and/or the piston to resist the fluid pressures and release the cores by contracting the expandable mandrels.

42 Claims, 13 Drawing Figures

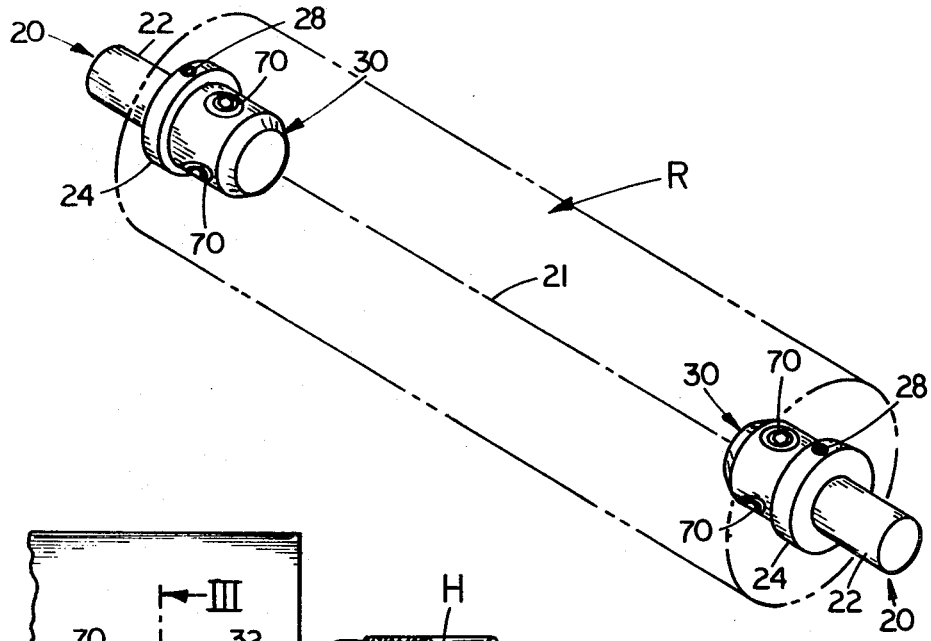
FIG. I
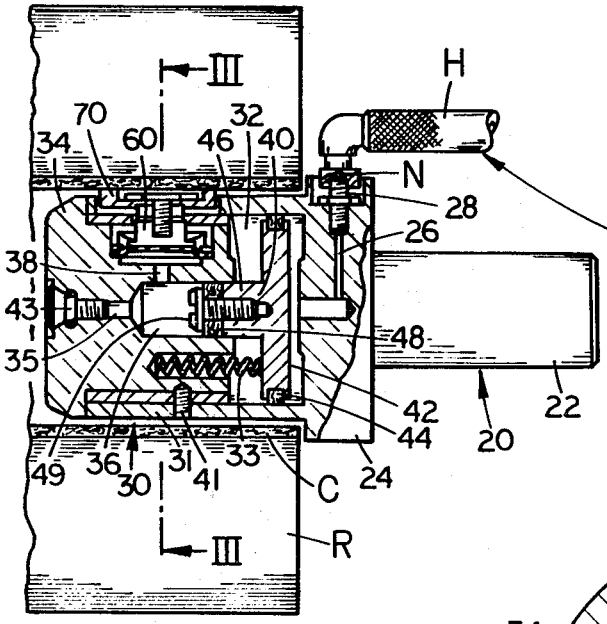
FIG. II
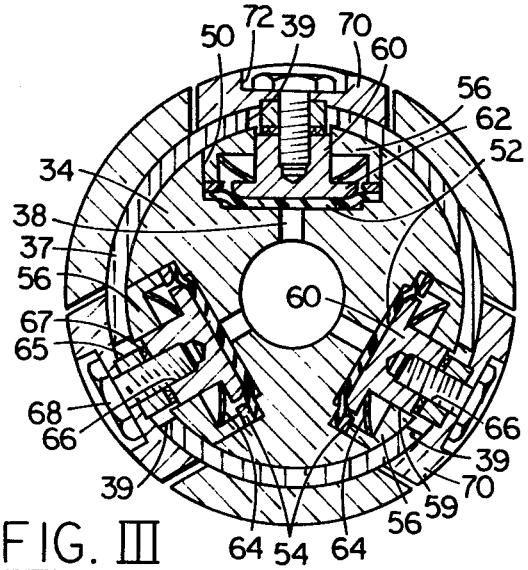
FIG. III

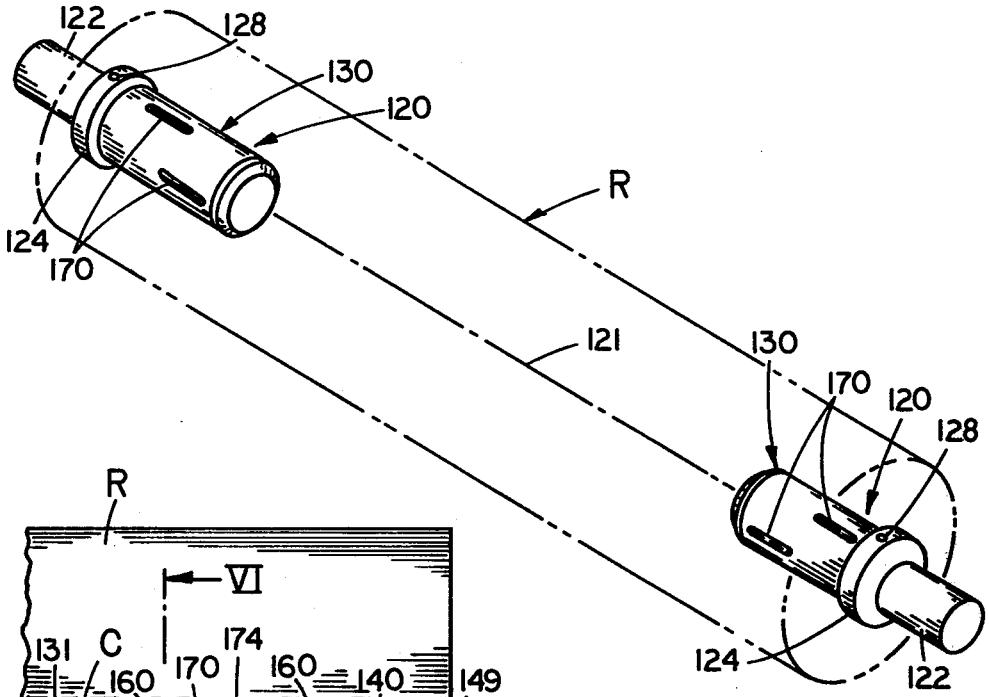
FIG. IV
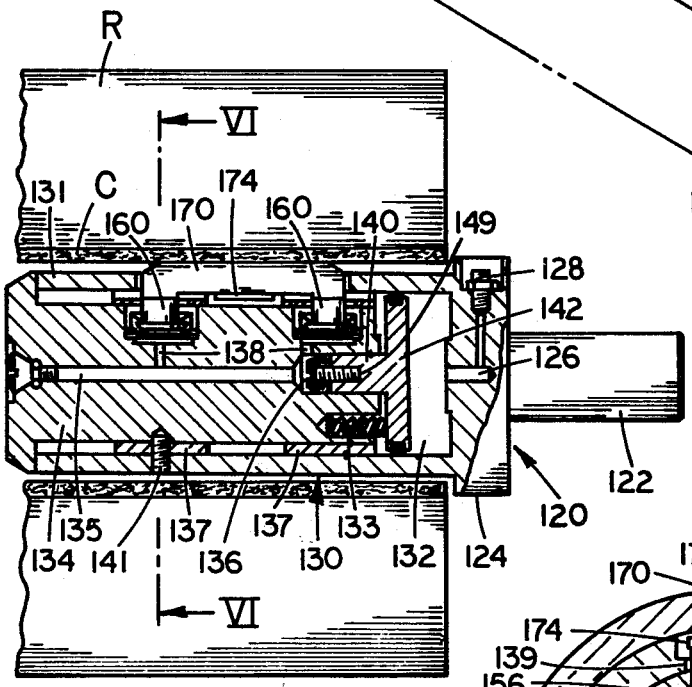
FIG. V
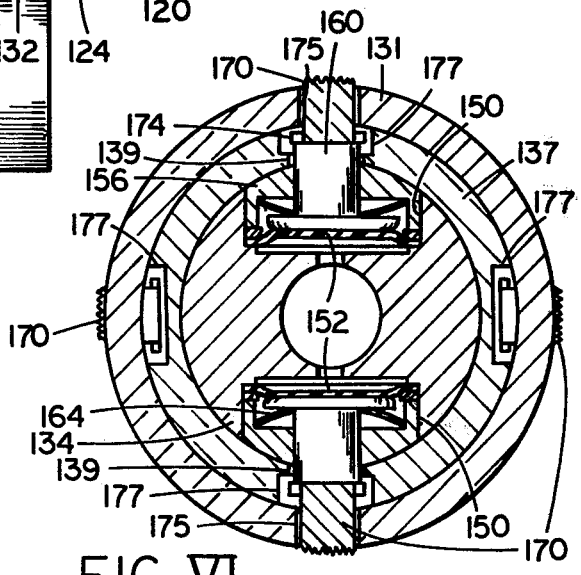
FIG. VI

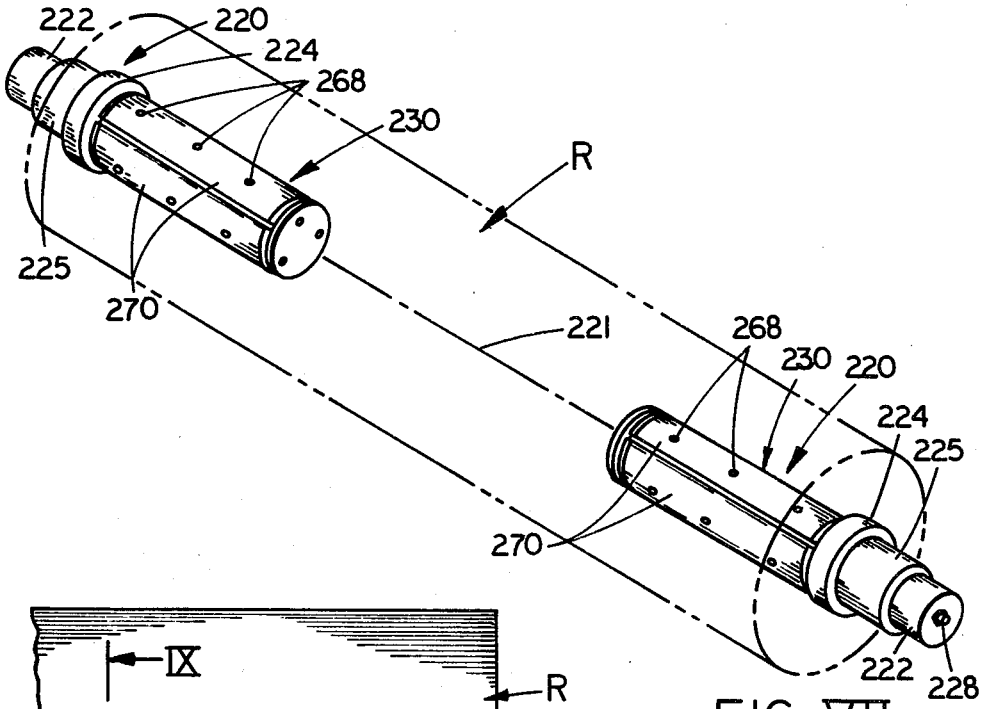
FIG. VII
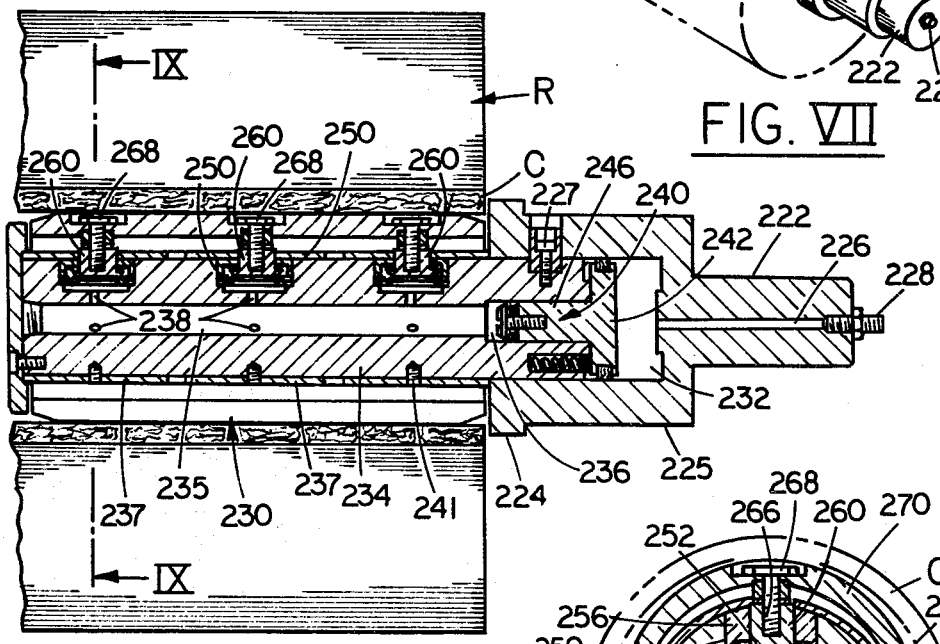
FIG. VIII
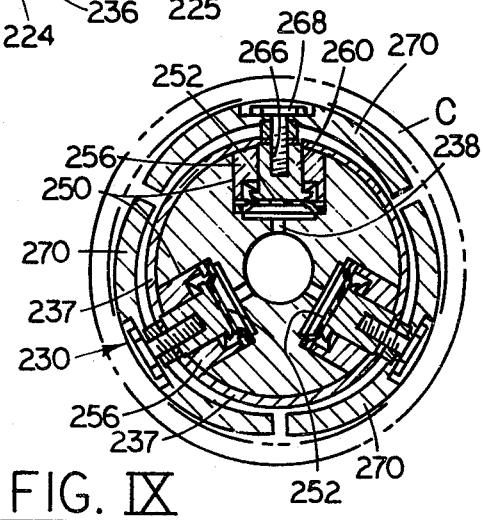
FIG. IX

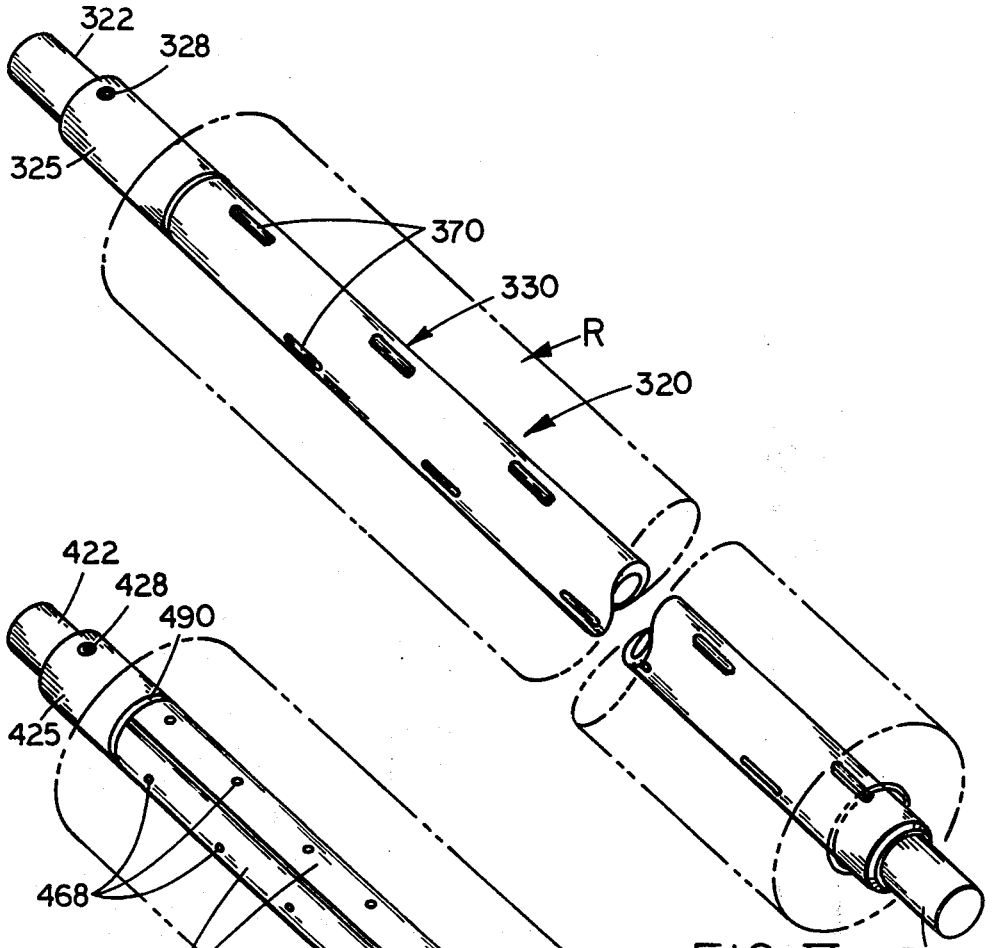
FIG. X
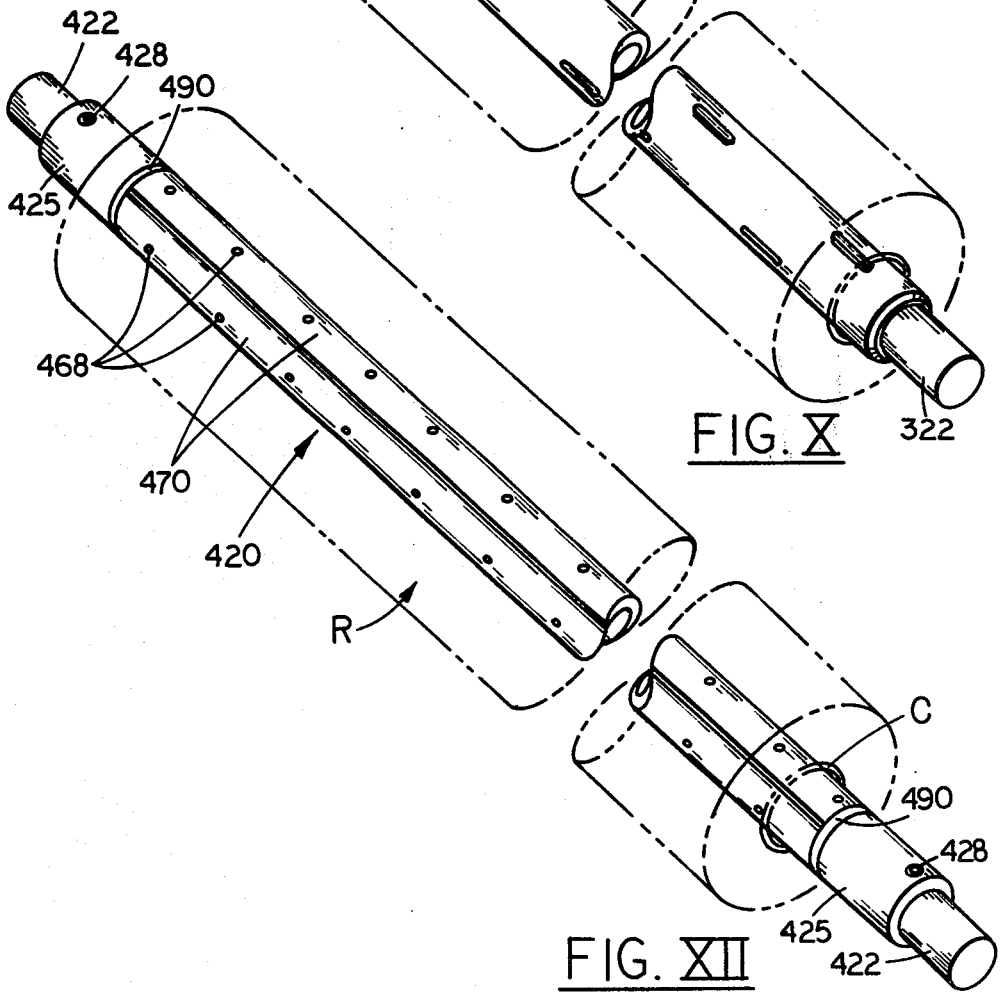
FIG. XII

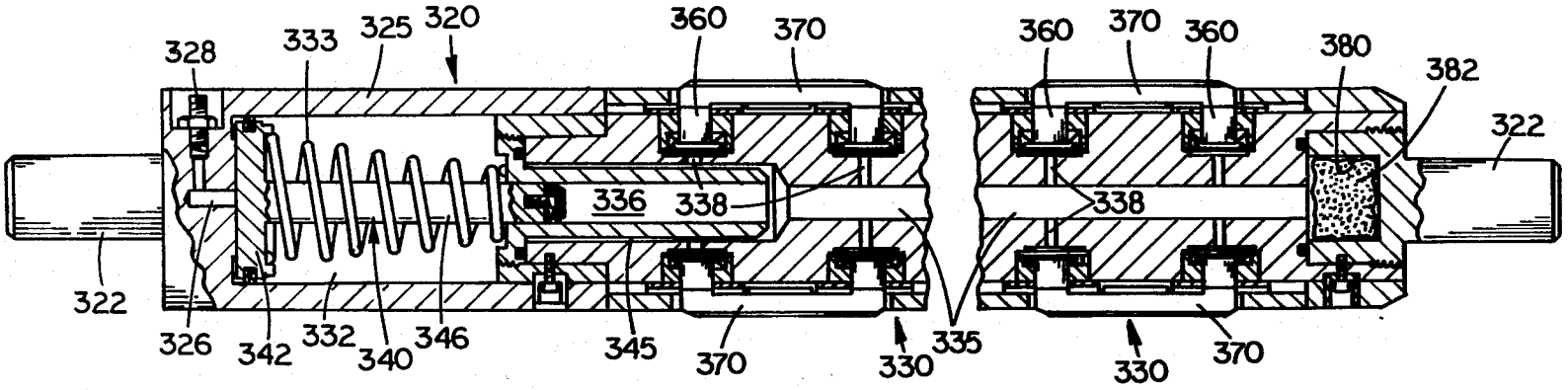
FIG. XI
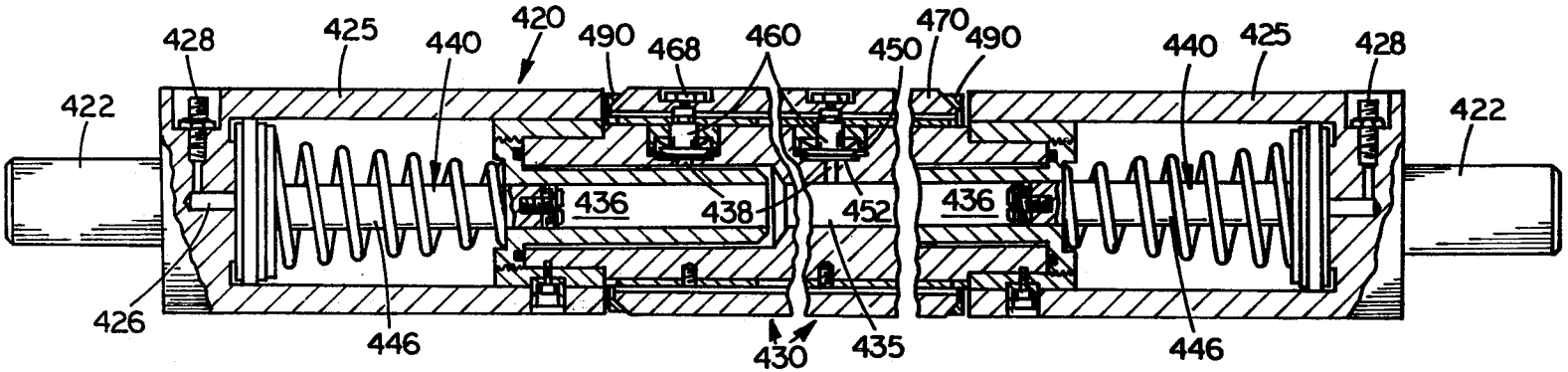
FIG. XIII

GAS-LIQUID HYDRAULIC EXPANDABLE CHUCKS AND SHAFTS

RELATED APPLICATIONS

This is an improvement application of Arthur D. Secor's U.S. Patent Application entitled "Expandable Core-Shafts," Ser. No. 577,777 filed May 15, 1975, now U.S. Pat. No. 4,050,643 the disclosures in which are now incorporated into this application by reference.

BACKGROUND OF THE INVENTION

Previously, expandable chucks and core-shafts were operated mechanically or by a single fluid system, either gas or liquid, which single fluid system usually inflated an expandable elastic bag inside the shaft to radially extend plungers, leaves or bars around the shaft as shown in Ochs et al. U.S. Pat. No. 3,908,926 issued Sept. 30, 1975. The limit of the pressure which could be applied per square inch to these bags without causing their rupture was usually about 200 psi, which automatically limited the grip that any of such chucks or expandable core-shafts could exert. Furthermore, these single fluid hydraulic systems were usually operated and controlled from a pressure source outside the chuck or shaft, thereby requiring a continuous connection between the source and the shaft, which also gave rise to leakage problems under high pressures because of the relative movement at the joint between the outside stationary duct and the rotating duct of the shaft. However, a self-contained pressurized fluid supply device is also known for a chuck in the Atherholt Jr. U.S. Pat. No. 3,122,376 issued Feb. 25, 1964.

Still further, self-contained prior art systems usually had difficulty in maintaining internal pressures, particularly if pressures were above about 200 psi, because of sealing problems between the movable parts, namely the edges of the pistons that operated the radial extending plungers or in the limit of the strength of the bag or expandable flexible chamber used in operating the plungers.

SUMMARY OF THE INVENTION

Generally speaking, the expandable chucks and core-shafts of this invention comprise two separate self-contained fluid systems, one a lower pressure gas system which operates through a movable piston having a relatively large surface area to pressurize a higher pressure liquid system by means of a piston of a smaller surface area directly connected to the piston of the larger surface area.

Some unexpected and unobvious advantages of this system are that a relatively low pressure periodically applied gas or air pressure can be used instead of a manual means, as the threaded sleeve for operating a master cylinder in the above mentioned copending application, for both multifold increase of the pressure in the liquid system which applies the grip of the chucks or core-shafts and also acts as an accumulator for maintaining this increase in pressure in the liquid system, in the event any leak might occur therein or excess pressure build-up due to increase in temperature of the chucks or shafts.

Thus, no manual operation is required for pressurizing and locking the liquid hydraulic system in the self-contained unit but only the pressurizing and depressurizing of the gas system, such as by a compressed air hose and its cooperating nozzle with a check valve of the type commonly used in pressurizing and depressurizing pneumatic automobile tires at a service station.

Because of the difference in area between the larger piston and the smaller piston, the pressure in the closed liquid system may be increased proportional to the difference in the areas of these two pistons, which for example may be about 10 to 1, namely 100 psi air pressure applied to the enclosed self-contained expandable chuck or shaft of this invention could produce correspondingly a 1000 psi liquid pressure in the hydraulic system for radially extending the gripping plungers to engage the inside of a core-shaft that is to be rotated by or with the expandable mandrel or chuck or shaft of this invention.

Furthermore, the separate gas system, directly connected through a piston with the closed liquid system, acts as a pressure regulator, accumulator and cushion for maintaining a predetermined higher pressure in the liquid system. This does not mean, however, that an additional accumulator may not be employed in the system as that disclosed in applicant's above mentioned copending application; nevertheless, it is not now necessary. In fact, if desired on long expandable shafts, separate pistons with their gas and liquid cylinders may be provided at each end of such shafts, thus having two separate air systems providing two accumulators for maintaining a constant predetermined liquid pressure in the liquid system.

It is very important that the hydraulic system of this invention does not leak or rupture, and therefore no inflatable-type bags are employed therein, nor are there any friction-type seals, such as pistons in cylinders, employed around the plungers, but contrary-wise each of the plungers are operated by separate diaphragms which are sealed positively at their peripheries and only flex centrally for the operation of their associated plungers which are radially positioned around and along the chuck and expandable shafts.

These plungers operate buttons, bars, leaves or segmented sleeves which extend axially along the expandable portions of the chucks or shafts, which buttons, bars and leaves may have hardened and/or roughened outer surfaces to frictionally engage the internal cylindrical surfaces of the hollow cores which are to be grabbed and held by the chucks and expandable shafts of this invention. These plungers preferably are held in place by circumferential sleeves that fit around the outside of the shaft means or central cylindrical portion of the chucks or shafts. The buttons and/or leaves connected thereto are usually attached by means of screws or bolts into the ends of the plungers. Each of these plungers also may be provided with a spring means for its individual retraction. Further, in order to insure retraction of the plungers, or in place of their separate springs, there also may be provided resilient means acting against the piston, which may take the form of a plurality of radially spaced compression springs located around the smaller piston or a singular helical spring surrounding the smaller piston, which acts against the back of the larger piston.

The separate ducts for the hydraulic liquid to each of the diaphragms from the pressurizing cylinder and its branch ducts or manifold to the diaphragms behind each plunger may be restricted to dampen any movement of the plungers on opposide sides of the chucks or shafts due to the weight of the roll thereon to prevent wobbling and eccentric vibration of the roll on the shaft.

Also frusto-conical rings may be employed around opposite bevelled ends on the leaves for maintaining equal outward radial movements of all the leaves and the centering of the roll on the chuck or shaft.

It is important that the liquid in the closed hydraulic system of the chucks and expandable shafts of this invention is substantially stable and has a low coefficient of expansion, particularly of the types of hydraulic liquid described in applicant's copending application above mentioned.

The expandable chucks of this invention are particularly adaptable for use on shaftless back stands for the rolls of web material such as paper; the expandable shafts are usually used for much heavier loads; and the leaves employed on the shafts or chucks are preferably used for high-speed full face webs or split webs of sheet materials.

OBJECTS AND ADVANTAGES

Accordingly, it is an object of this invention to produce an efficient, effective, economic, durable, self-contained, high-torque and high-pressure chuck or expandable shaft which does not leak and which maintains a preset high pressure over relatively long periods of time.

It is another object to produce such a chuck or shaft that is relatively free of maintenance, easy to control and operate, compact, self-centering, and develops up to at least about 1000 psi liquid hydraulic clamping pressure and thereby develops a high torque capacity enabling operation at high speeds and with heavy loads and/or large rolls.

Another object is to produce such a chuck or shaft with a self-contained accumulator for maintaining a positive predetermined liquid pressure on all of its gripping plungers regardless of leakage and/or changes in temperature.

BRIEF DESCRIPTION OF THE VIEWS

The above mentioned and other features, objects and advantages, and a manner of attaining them are described more specifically below by reference to embodiments of this invention shown in the accompanying drawings, wherein:

FIG. I is a perspective view of a pair of chucks according to one embodiment of this invention engaging opposite ends of the core of a roll of web material (shown in dot-dash lines), which chucks have radially extending buttons on their core inserted mandrel portions;

FIG. II is an enlarged longitudinal diametrical cross-sectional view of the operating mechanism of one of the chucks shown in FIG. I;

FIG. III is a further enlarged sectional view taken along line III—III of FIG. II showing the plunger operation mechanism for the buttons;

FIG. IV is a perspective view of a pair of chucks according to another embodiment of this invention in the opposite ends of a roll as shown in FIG. I, which chucks have radial extending bars instead of buttons;

FIG. V is an enlarged longitudinal diametrical cross-sectional view through one of the chucks shown in FIG. IV;

FIG. VI is a further enlarged sectional view taken along lines VI—VI of a chuck similar to that shown in FIG. V;

FIG. VII is a perspective view similar to FIGS. I and IV of another embodiment of a chuck according to this invention but having leaves operated by the radial plungers;

FIG. VIII is an enlarged longitudinal diametrical cross-sectional view of one of the chucks shown in FIG. VII;

FIG. IX is a further enlarged sectional view taken along line IX—IX of FIG. VIII;

FIG. X is a perspective view of an expandable shaft employing the bars similar to those shown in FIGS. IV through VI;

FIG. XI is an enlarged longitudinal section of the shaft in FIG. X showing another embodiment of the piston-operating mechanism;

FIG. XII is a perspective view similar to FIG. X of an expandable shaft employing leaves similar to those shown in FIGS. VII through IX; and FIG. XIII is an enlarged longitudinal section of the shaft shown in FIG. XII having a gas or air operated piston at each end thereof.

DETAILED DESCRIPTION OF PREFERRED EMBODIMENTS

Section A - Chucks

I - Button-Type Chucks

Referring first to the embodiment shown in FIGS. I, II and III, FIG. I shows a pair of spaced button-type expandable chucks 20 located at opposite ends of a hollow core C supporting a roll R of a web, which roll and chucks are aligned along a centerline 21. Each of these chucks 20 comprises a trunnion or bearing shaft portion 22, a central disc portion 24, and an expandable mandrel or shaft means portion 30, all three of which portions are cyindrical, axially aligned and integrally connected together.

The trunnion or bearing portion 22 may be keyed, if desired, for connection to a driving means for rotating the chucks 20 and the roll R, such as by means of gears, belts, etc., as desired.

The central disc-shaped portion 24 is of largest diameter and acts as a flange for limiting the insertion of the expandable portion 30 into the core of the roll to be grabbed thereby. Also it may be provided with an L-shaped radial and axial duct 26 (see FIG. II) at the outer end of which is provided a check valve means 28, which may be similar to the type of check valve employed for pneumatic tires for automobiles, to which may be connected an air pressure hose H with nozzle N cooperating with a check valve 28 as shown in FIG. II for periodically pressurizing or depressurizing the fluid systems in the chuck 20.

The expandable mandrel portion or shaft means 30 comprises herein a hollow cylindrical section 31 integral with the flange or disc means 24 providing gas or air chamber 32 in which the larger end 42 of an axially reciprocating piston 40 slides. Anchored by set screws 41 in the outer end of this cylindrical section 32 is a central expandable shaft or mandrel section 34 having at its inner end a second and smaller hydraulic liquid chamber 36 in which the smaller end 46 of the piston 40 slides. Between the adjacent annular ends of the mandrels 34 and larger end 42 of the piston 40 there may be one or a plurality, such as three, equally angularly spaced compression springs 33 for normally urging the piston 40 into its full line decompressed fluids position shown. The smaller piston end 46 compresses the hydraulic liquid in the chamber 36 and the ducts 35 and 38 that extend axially and radially outwardly from the chamber 36 to the radially extending plungers 60. At the outer end of the axial duct 35 there may be located a plug 43 for filling the system with the hydraulic liquid. The larger portion 42 of the piston 40 is provided with a peripheral sealing gasket 44 and the smaller portion 46 of the piston 40 is similarly provided with a sealing gasket 48 which latter gasket 48 may be held in place by means of a screw 49.

The outer ends of the radially extending ducts 38 (see FIG. III) communicate with the bottoms or inner ends of enlarged cylindrical pocket-portions 50 into which are mounted diaphragms 52 held peripherally against these bottoms by means of seating rings 54 which in turn may be held in place by inverted cup means 56 which in turn are held in place by means of circumferential ring 37 with radial apertures 39 of lesser diameter than the diameter of the cylindrical pockets 50. However, if desired, these cups 56 may be threaded into the pockets 50 instead of being held therein by the sleeve 37, and/or the seating rings 54 may be split snap rings in grooves in the cylindrical side walls of the pockets 50 near their bottoms adjacent the diaphragms 52, without departing from the scope of this invention, similarly to the manner shown in applicant's above mentioned copending application.

Inside the cups 56 and outside the diaphragms 52 are provided the rams or plungers 60 which have outwardly extending flange portions 62 of greater diameter than the central apertures 59 and 39 in the cup 56 and sleeve 37, respectively, which flange portions 62 are in the cups adjacent the diaphragms 52. Between the inside of the cups 56 and these flange portions 62 there are preferably provided spring means 64, which in the present instance are shown to be of the leaf type, for normally urging the plungers 60 into their retracted positions as shown in FIG. III. The outer end of the plungers 60 herein may be provided with a centrally tapped holes 66 into which may be threaded bolts 68 for holding buttons 70 which preferably have roughened outer surfaces and central countersunk portions 72 for the heads of the bolts 68. Between buttons and the plungers 60 there may be provided sleeves 65 and/or lock washers 67 for anchoring the buttons 70 to the plungers 60.

The chucks 20 are operated when placed in opposite ends of the hollow cores C of the rolls R that are to be positively gripped. Then the hose H and its nozzle N is applied to the check valve 28 on each chuck to apply air pressure to chamber 32 on the larger end 42 of the piston 40 adjacent the duct 26 to force the piston 40 to compress the hydraulic liquid in the chamber 36 at a higher pressure in a ratio equal to the difference between the areas of the outer ends of larger piston portion 42 and the smaller piston portion 46. This increased pressure then forces the hydraulic liquid through the ducts 38 into the pockets 50 below the diaphragms 52 to flex these diaphragms 52 outwardly and thereby push the plungers 60 against the action of the springs 64 to extend the buttons 70 into gripping relationship with the internal cylindrical surface of the core C. During the gripping operation of the chucks 20, the air pressure in the chamber 32 between on the outer surface of the piston portion 42 acts as an accumulator to maintain the pressure on the liquid in the cylinder 36, which simultaneously maintains the plungers 60 under the same desired pressure even if there is slight leakage in the hydraulic or liquid system and/or if the liquid system rises in temperature. Thus the air pressure in the chamber 32 continues to maintain the desired high clamping pressure on the core C throughout its operation without the application or adjusting of the pressure on the plungers 60 from an outside source.

After the roll R or the use of the chucks 20 has been completed and the core C is to be released, a pointed instrument is then placed inside the valve 28 to release the check valve pin thereof, as in a pneumatic tire-type check valve, thereby releasing the air pressure in the chamber 32 so that the springs 33 as well as also the springs 64 will cause the retraction of piston 40 and the plungers 60 into their full line positions shown in FIGS. II and III. Thus the diameter of the expandable mandrel section 30 of each of the chucks 20 is now less than the internal diameter of the core C so that the chucks 20 can be removed from the core C and roll R.

A-II — Bar-Type Chuck

Referring now to FIGS. IV, V and VI, there is shown a pair of chucks 120 similar to the chucks 20 described in FIGS. 1, II and III in which the parts having similar functions have the same reference character digits with the prefix 100. For example, the chucks 120 in FIG. IV are aligned along centerline 121 for the roll R and have trunnion bearings 122, central disc flanges 124 with L-shaped radial and axial ducts 126 at the outer ends of which are check valves 128 for engagement with a nozzle N on a hose H as shown in FIG. II.

In this embodiment the expandable mandrel section 130 is shown to be slightly longer axially than that of the section 30 shown in FIGS. I and II, in that in place of the gripping buttons 70 there are provided axially longitudinal gripping bars 170, each of which is operated by two separate axially spaced plungers 160. These bars 170 may be angularly spaced around the cylindrical portion 130, each 90°, 120° or 180° as shown in FIG. VI. In order to provide the ducts for the pairs of plungers 160, the central duct 135 may be elongated as shown in FIG. V and have radially extending branches 138. These plungers 160, however, need not be provided with an internally threaded aperture, in that the bars 160 may be held in place by their centrally located longitudinal base flanges 174 (see FIGS. V and VI) that extend circumferentially outwardly farther than the width of the slots 175 provided in the hollow shaft section 131 that houses the cylinder chamber 132 and the internal shaft portion 134. The axially spaced sleeves or rings 137 which hold the cups 156 in their pockets 150, have axial slots 177 therein over their plunger-provided radial holes 139 so that they and the bars 170 with their flanges 174 can readily be assembled in the hollow shaft 131. The outer surface of the bars 17 may be roughened longitudinally as shown in FIG. VI, if desired, to increase their grip on the inside of the core C of the roll R.

The double-piston 140 acts and operates similar to piston 40 described previously in connection with FIGS. II and III, namely that when the chucks 120 are to be energized or clamped into the core C, the air from a hose H is applied to the valve 128 to pressurize the air in chamber 132 to move the piston 140 to highly pressurize the liquid in chamber 136, which in turn pushes outwardly each of the diaphragms 152 to project radially outwardly the bars 170 to engage the inside of core C. This is maintained under gas or air pressure in the cylinder chamber 132 as shown in full lines in FIGS. V and VI. Furthermore, the difference in the sizes of the areas of the smaller ends 146 of the pistons 140 for the liquid with respect to that of the larger ends 142, corresponds to the number of times the pressure in the liquid system is greater than that in and applied by the air system.

A-III — Leaf-Type Chuck

The embodiment of the leaf-type chucks 220 is shown in FIGS. VII, VIII and IX, and has similar 200 digit reference characters for similar parts to those described in the two previous embodiments.

Herein, however, the structure of the chucks 220 is slightly different in view of the fact that the leaves take up substantially all of the axial and circumferential surface of the mandrel portion 230. Thus the chamber 232 for the piston 240 herein may be located in the cylinder portion 225 outside of the end of the roll R on the same side of the disc flange 224 as the bearing portion 222. This cylinder portion 225 for the piston 240 usually has a larger diameter than that of the bearing portion 222, and may have its chamber 232 connected to an axial duct 226 to the air check valve 228 in the center of the outer end of the bearing portion 222. The base or internal shaft portion 234 fits into the open end of and is attached to the cylinder portion 225, such as by means of radially extending set screws or keys 227.

The smaller diameter liquid cylinder 236 is located axially in the end of the shaft portion 234 adjacent the cylinder 232. An axial duct 235 extends from the cylinder 236 to the radial restricted diameter branching ducts 238 which connect with the plunger pockets 250. In the bottoms of each pocket 250 are the flexible diaphragms 252 which push out the plungers 260. These plungers 260 herein are provided with central internally threaded holes 266 for the bolts 268 which hold on the leaves 270 in a similar manner to which the buttons 70 are held, as shown in FIG. III. The external surfaces of the leaves 270 may be roughened and the leaves are shown in their extended core C gripping positions in FIGS. VIII and IX as distinguished from the retracted positions for the expandable chucks shown in FIGS. II and III. The cups 256 are held in place by the axially spaced sleeves 237, which sleeves are anchored to the central shaft portion 234 by set screws 241.

The other portions of this embodiment are assembled similar to those previously described in the previous embodiments and their operation is correspondingly similar.

Section B — Expandable Core-Shafts

Referring now to FIGS. X through XIII, there are shown expandable core-shafts which extend completely through the cores C of the rolls R and which have self-contained gas-liquid fluid control systems in one or both ends thereof.

B-I — Bar-Type Shafts

In the embodiment shown in FIGS. X and XI the core-shaft 320 has longitudinal 180° angularly offset alternate pairs of diametrically opposite gripping bars 370 similar to the bars 170 in FIGS. IV, V and VI. The pairs of plungers 360 which radially extend these bars 370 are controlled hydraulically through restricted radial branch ducts 338 from a common central duct 335 (see FIG. XI) extending axially the full length of the expandable shaft or mandrel 330 from the cylinder 336 at one end of the shaft 320. This shaft 320 has bearing trunnions 322 at each end thereof, and at at least one end thereof a cylinder portion 325 for the control piston 340, which portion 325 may extend outside of the core C and contain the air inlet radial duct 326 and check valve 328.

In this embodiment the larger end 342 of the piston 340 is shown engaging a helical spring 333 surrounding the smaller portion 346 of the piston 340, which smaller piston portion 346 extends into an elongated smaller cylinder chamber portion 336 which concentrically fits into a larger cylindrical opening 345 with a clearance there around so that the hydraulic liquid can flow outside the cylinder 336 to the first one of pair of plungers 360 at that end of the expandable shaft portion 330. This type of a construction also may be embodied in the chucks previously described in Section A above.

Although the gas or air chamber 332 acts as an accumulator to maintain the preset pressure on the hydraulic liquid in the cylinder 336 and its system in the shaft 330, there also may be provided at the opposite end of the shaft 320 from that of the cylinder chamber 332 another chamber 380 in which may be a sealed collapsible bag 382 filled with a compressible gas which also acts as an accumulator or pressure maintaining means for the liquid hydraulic system in ducts 335 and 338 and chamber 336. Nevertheless, if there are leaks that occur in both systems, the pre-pressure applied to the gas in bag 382 will compensate automatically to maintain the desired pressure in the liquid system throughout its operation. Also it is to be understood that in place of the bag 382 there may be provided a spring actuated cylinder similar to that shown in the accumulator of the prior copending application referred to above.

B-II — Leaf-Type Shaft

Referring now to FIGS. XII and XIII, the expandable leaf shaft 420 is provided with leaves 470 (similar to leaves 270 in FIGS. VII, VIII and IX) extending substantially the full length thereof, which leaves 470 may be divided into sectors, such as 90° or 120° each, surrounding the whole expandable shaft portion 430. The opposite ends of the shaft 420 are provided with trunnion bearings 422 and in this particular instance, instead of employing an accumulator 382 at one end as shown in FIG. XI, there is provided a second gas or air operated cylinder and piston means 425, so that both ends of the shaft 420 are the same.

Once the core C for the roll R is placed on the shaft 420, air pressure is applied to the valves 428 at each end thereof, such as by a hose H as shown in FIG. II, so that both ends of the shaft and liquid fluid system are pressurized, and the two air hydraulic systems equalize each other in maintaining a constant higher pressure on the central liquid hydraulic system in the ducts 435 and 438, and smaller pistons 446 in chambers 436. Thus each of the plungers 460 which are connected along and to the leaves 470 by the screws 468 are equalized and the core C gripping pressure is maintained substantially uniform throughout the operation of shaft 420.

The relatively small size of, or restrictions in the, ducts 438 between axial supply duct 435 or manifold and the pockets 450 for the plungers 460 and their diaphragms 452, has a damping action on the flow of the hydraulic liquid from the pockets 450 along one side of the shaft 420 due to the weight of the roll R thereon, and thus prevent eccentricity of the roll R on the shaft 420 and vibration when rotated, particularly at higher speeds. This eccentricity and vibration also may be reduced by making the plunger-retracted diameter of the expandable shaft substantially the same as the inside diameter of the core C, and/or by the use of rings 490 at each end of the leaves, which ends are beveled to fit into cooperating frusto-conical depressions or internal bevels of the rings 490.

While there is described above the principles of this invention in connection with specific apparatus, it is to be clearly understood that this description is made only by way of example and not as a limitation to the scope of this invention.

We claim:

1. An expandable mandrel comprising a rotatable shaft means having self-contained gas and closed liquid hydraulic system comprising:

(A) a gas cylinder having a valved inlet, (B) a liquid cylinder having a smaller cross-sectional area than said gas cylinder, (C) a single piston means reciprocal in both said cylinders, (D) check valve means in said inlet for gas to said gas cylinder for connection of a pressure source when said shaft is stationary, (E) a plurality of radially extending rams surrounding said mandrel, (F) liquid duct means from said liquid cylinder to said rams, and (G) diaphragm means between the inner ends of each of said rams and the liquid in said duct means, whereby gas pressure applied to said check valve means moves said piston to apply an increased pressure to the liquid in said liquid cylinder to move said rams radially outwardly to grip a hollow cylindrical object into which said mandrel is positioned and to maintain the liquid pressure for said grip by the compressed gas in said gas cylinder until the pressure of said gas is released by operation of said check valve means.

2. A mandrel according to claim 1 wherein said gas cylinder has a cross-sectional diameter several times that of said liquid cylinder.

3. A mandrel according to claim 1 wherein said gas is compressed air and said check valve means is a pneumatic tire-type check valve means.

4. A mandrel according to claim 1 wherein said rams include longitudinal bar means for engaging the inside of a core-shaft.

5. A mandrel according to claim 1 wherein said rams are connected to sector-shaped leaves surrounding said mandrel for substantially engaging the entire hollow cylindrical surface of a core.

6. A mandrel according to claim 1 including a ring means around said mandrel and having radial apertures therein aligned with and for said rams for retaining said rams in said mandrel.

7. A mandrel according to claim 1 wherein said piston means includes a resilient means for normally urging said piston means toward said inlet.

8. A mandrel according to claim 1 wherein said rams include resilient means for normally urging said rams radially inwardly of said mandrel.

9. A mandrel according to claim 1 including a bearing means for rotatably mounting said mandrel axially spaced and aligned with said expandable mandrel.

10. A mandrel according to claim 1 wherein said shaft means has bearing means for rotatably mounting said mandrel at each end thereof.

11. A mandrel according to claim 10 wherein said shaft means has a gas cylinder and a liquid cylinder with said piston means therein at each end of said shaft.

12. A mandrel according to claim 10 wherein shaft means includes an additional accumulator means connected to said liquid duct means for maintaining a substantially constant pressure in said system.

13. A mandrel according to claim 12 wherein said accumulator means comprises a sealed bag filled with a compressible fluid.

14. An expandable rotatable shaft means having a self-contained compressed gas operating a closed liquid hydraulic system comprising:

(A) a first chamber in said shaft means connected to a plurality of radially extending ducts, (B) a first piston means in said first chamber, (C) a substantially stable liquid in said first chamber and said ducts, (D) separate rams at the outer ends of said radially extending ducts for projecting outwardly from the circumference of said shaft means to grip the inside of a core surrounding said shaft means, (E) separate diaphragm means in said radially extending ducts between the inner ends of each of said rams and said liquid in said radial ducts, (F) a second chamber in said shaft means having a cross-sectional area greater than that of said first chamber, and having a valved inlet for connection to a pressure source when said shaft means is stationary, (G) a second piston means in said second chamber and directly connected to said first piston means to operate said first piston means to pressurize said liquid to operate said rams, and (H) means for removably supplying compressed gas to said valved inlet for operating said second piston means and for providing a contractable and expandable accumulator means for limiting and maintaining a predetermined liquid pressure in said first chamber several times greater than the pressure of said compressed gas in said second chamber.

15. A shaft means according to claim 14 wherein said shaft means comprises a short chuck-type shaft.

16. A shaft means according to claim 14 wherein said ducts also include a duct extending axially of said shaft means and said rams are spaced longitudinally along said axial duct.

17. A shaft means according to claim 14 wherein the outer surface of said rams that engages a core is roughened.

18. A shaft means according to claim 14 including resilient means for normally urging said rams radially inwardly of said shaft means.

19. A shaft means according to claim 14 including longitudinal sector leaves radially anchored to said rams.

20. A shaft means according to claim 14 including an additional accumulator means in said shaft means connected to said ducts for maintaining and limiting the liquid pressure that can be applied to said diaphragm means.

21. A shaft means according to claim 14 having two said first and said second chamber means and two said first and said second piston means, one at each end of said shaft means.

22. An expandable mandrel comprising a rotatable shaft means having a self-contained gas and closed liquid hydraulic system comprising:

(A) a gas cylinder having a valved inlet, (B) a liquid cylinder having a smaller cross-sectional area than said gas cylinder, (C) a single piston means reciprocal in both said cylinders, p1 (D) check valve means in said inlet for gas to said gas cylinder for connection of a pressure source when said shaft is stationary, (E) a plurality of radially extending rams surrounding said mandrel, and (F) liquid duct means from said liquid cylinder to said rams, whereby gas pressure applied to said check valve means moves said piston to apply an increased pressure to the liquid in said liquid cylinder to move said rams radially outwardly to grip a hollow cylindrical object into which said mandrel is positioned and to maintain the liquid pressure for said grip by the compressed gas in said gas cylinder until the pressure of said gas is released by operation of said check valve means.

23. A mandrel according to claim 22 wherein said gas cylinder has a cross-sectional diameter several times that of said liquid cylinder.

24. A mandrel according to claim 22 wherein said gas is compressed air and said check valve means is a pneumatic tire-type check valve means.

25. A mandrel according to claim 22 wherein said rams include longitudinal bar means for engaging the inside of a core-shaft.

26. A mandrel according to claim 22 wherein said rams are connected to sector-shaped leaves surrounding said mandrel for substantially engaging the entire hollow cylindrical surface of a core.

27. A mandrel according to claim 22 including a ring means around said mandrel and having a radial apertures therein aligned with and for said rams for retaining said rams in said mandrel.

28. A mandrel according to claim 22 wherein said piston means includes a resilient means for normally urging said piston means toward said inlet.

29. A mandrel according to claim 22 wherein said rams include resilient means for normally urging said rams radially inwardly of said mandrel.

30. A mandrel according to claim 22 including a bearing means for rotatably mounting said mandrel axially spaced and aligned with said expandable mandrel.

31. A mandrel according to claim 22 wherein said shaft means has bearing means for rotatably mounting said mandrel at each end thereof.

32. A mandrel according to claim 31 wherein said shaft means has a gas cylinder and a liquid cylinder with said piston means therein at each end of said shaft.

33. A mandrel according to claim 31 wherein said shaft means includes an additional accumulator means connected to said liquid duct means for maintaining a substantially constant pressure in said system.

34. A mandrel according to claim 33 wherein said accumulator means comprises a sealed bag filled with a compressible fluid.

35. An expandable rotatable shaft means having a self-contained compressed gas operating a closed liquid hydraulic system comprising:

(A) a first chamber in said shaft means connected to a plurality of radially extending ducts, (B) a first piston means in said first chamber, (C) a substantially stable liquid in said first chamber and said ducts, (D) separate rams at the outer ends of said radially extending ducts for projecting outwardly from the circumference of said shaft means to grip the inside of a core surrounding said shaft means, (E) a second chamber in said shaft means having a cross-sectional area greaer than that of said first chamber, and having a valved inlet for connection to a pressure source when said shaft means is stationary, (F) a second piston means in said second chamber and directly connected to said first piston means to operate said first piston means to pressurize said liquid to operate said rams, and (G) means for removably supplying compressed gas to said valved inlet for operating said second piston means and for providing a contractable and expandable accumulator means for limiting and maintaining a predetermined liquid pressure in said first chamber several times greater than the pressure of said compressed gas in said second chamber.

36. A shaft means according to claim 35 wherein said shaft means comprises a short chuck-type shaft.

37. A shaft means according to claim 35 wherein said ducts also include a duct extending axially of said shaft means and said rams are spaced longitudinally along said axial duct.

38. A shaft means according to claim 35 wherein the outer surface of said rams that engages a core is roughened.

39. A shaft means according to claim 35 including resilient means for normally urging said rams radially inwardly of said shaft means.

40. A shaft means according to claim 35 including longitudinal sector leaves radially anchored to said rams.

41. A shaft means according to claim 35 including an additional accumulator means in said shaft means connected to said ducts for maintaining and limiting the liquid pressure that can be applied to said rams.

42. A shaft means according to claim 35 having two said first and said second chamber means and two said first and said second piston means, one at each end of said shaft means.

* * * * *